US008960670B2

(12) United States Patent
Inoue et al.

(10) Patent No.: US 8,960,670 B2
(45) Date of Patent: Feb. 24, 2015

(54) IMAGE FORMING APPARATUS INCLUDING SHEET CONVEYER CONVEYING A SHEET AND GUIDE GUIDING THE SHEET

(71) Applicants: Masafumi Inoue, Tajimi (JP); Hikaru Iino, Niwa-gun (JP)

(72) Inventors: Masafumi Inoue, Tajimi (JP); Hikaru Iino, Niwa-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/038,880

(22) Filed: Sep. 27, 2013

(65) Prior Publication Data

US 2014/0117617 A1 May 1, 2014

(30) Foreign Application Priority Data

Oct. 31, 2012 (JP) ..... 2012-241042

(51) Int. Cl.

| | |
|---|---|
| ***B65H 7/02*** | (2006.01) |
| ***B65H 7/20*** | (2006.01) |
| ***G03G 15/23*** | (2006.01) |
| ***G03G 15/00*** | (2006.01) |
| ***B65H 85/00*** | (2006.01) |
| ***B65H 5/38*** | (2006.01) |

(52) U.S. Cl.

CPC ..... *B65H 7/20* (2013.01); *G03G 15/234* (2013.01); *G03G 15/6561* (2013.01); *B65H 85/00* (2013.01); *B65H 5/38* (2013.01); *G03G 2215/00586* (2013.01); *B65H 2402/44* (2013.01); *B65H 2405/31* (2013.01); *B65H 2511/11* (2013.01); *B65H 2511/20* (2013.01); *B65H 2511/222* (2013.01); *B65H 2513/40* (2013.01); *B65H 2513/51* (2013.01); *B65H 2801/06* (2013.01)

USPC ..... 271/258.01; 271/164

(58) Field of Classification Search

CPC ..... G03G 15/234; G03G 15/6579; G03G 21/1638; G03G 2215/0043; G03G 2215/00434; G03G 2215/00438

USPC ..... 271/164, 258.01; 399/124, 401

See application file for complete search history.

(56) References Cited

U.S. PATENT DOCUMENTS

| | | | | |
|---|---|---|---|---|
| 5,727,784 | A | 3/1998 | Sagawa | |
| 7,809,290 | B2 * | 10/2010 | Tamagaki | 399/21 |
| 7,957,687 | B2 * | 6/2011 | Ito | 399/389 |
| 8,047,539 | B2 * | 11/2011 | Fujita | 271/259 |
| 8,186,674 | B2 * | 5/2012 | Fujita | 271/259 |
| 2012/0104678 | A1 | 5/2012 | Iino et al. | |

FOREIGN PATENT DOCUMENTS

| | | | |
|---|---|---|---|
| JP | H07-309478 | A | 11/1995 |
| JP | 2009-031422 | A | 2/2009 |
| JP | 2012-096858 | A | 5/2012 |

* cited by examiner

*Primary Examiner* — Jeremy R Severson

(74) *Attorney, Agent, or Firm* — Banner & Witcoff, Ltd.

(57) ABSTRACT

An image forming apparatus includes a sheet conveyer, a main body, a movable unit movable with respect to a guide position at which the sheet is guided, a position detector outputting a position detection signal, and a controller configured to determine whether the movable unit is in the guide position based on the position detection signal, perform a feeding execution process in which controlling the conveyer to feed the sheet by a feeding amount and stop the sheet if the sheet is in a feeding area and if determining that the movable unit is not in the guide position, and perform a feeding inexecution process in which controlling the conveyer not to feed the sheet by the feeding amount and stop the sheet if the sheet is in the feeding area and if determining that the movable unit is in the guide position.

11 Claims, 5 Drawing Sheets

IMAGE FORMING APPARATUS INCLUDING SHEET CONVEYER CONVEYING A SHEET AND GUIDE GUIDING THE SHEET

CROSS REFERENCE TO RELATED APPLICATION

The present application claims priority from Japanese Patent Application No. 2012-241042 filed on Oct. 31, 2012, which is incorporated herein by reference.

TECHNICAL FIELD

The present disclosure relates to a technique for controlling conveyance of a sheet that is conveyed by a conveyer included in an image forming apparatus and guided by a guide member.

BACKGROUND

It is known that a sheet conveyer of an image forming apparatus includes a main body and a movable body. The main body includes a main body guide and the movable body includes a movable body guide. The movable body is mounted movably from a guide position with respect to the main body. The sheet is guided in the guide position that is defined by the movable body guide and the main body guide. As one example, it has been known that an image forming apparatus includes a re-conveyer that re-conveys a sheet on which an image is formed by the image forming unit and that is reversed up-side-down. The re-conveyer conveys the reversed sheet to the image forming unit again. A conveyer unit including the re-conveyer is detachably mounted to the main body.

SUMMARY

In such an image forming apparatus, the movable body may be removed from the main body by a user during the conveyance of the sheet and the movable body may not be in the guide position. In such a case, the conveyance of the sheet is stopped and this may increase a user's load of a maintenance operation of removing the sheet remaining in the main body guide.

According to the technology of the description, if a movable unit is removed from a main body and the movable unit is not in a guide position, a user is required to remove a sheet from the main body, and in such a case, a user's load of maintenance operation of removing the sheet is reduced.

An image forming apparatus includes a conveyer configured to convey a sheet, a main body including a main body guide guiding the sheet that is conveyed by the conveyer, the main body further including an image forming unit forming an image on the sheet, a movable unit including a movable unit guide guiding the sheet that is conveyed by the conveyer, the movable unit being movable with respect to a guide position at which the sheet is guided, a position detector configured to output a position detection signal according to a state of the movable unit representing whether the movable unit is in the guide position or not; and a controller configured to determine whether the movable unit is in the guide position based on the position detection signal, perform a feeding execution process in which controlling the conveyer to feed the sheet by a feeding amount and stop the sheet if the sheet is in a feeding area and if determining that the movable unit is not in the guide position, and perform a feeding inexecution process in which controlling the conveyer not to feed the sheet by the feeding amount and stop the sheet if the sheet is in the feeding area and if determining that the movable unit is in the guide position.

DETAILED DESCRIPTION

<Illustrative Aspect>

Figure 1:
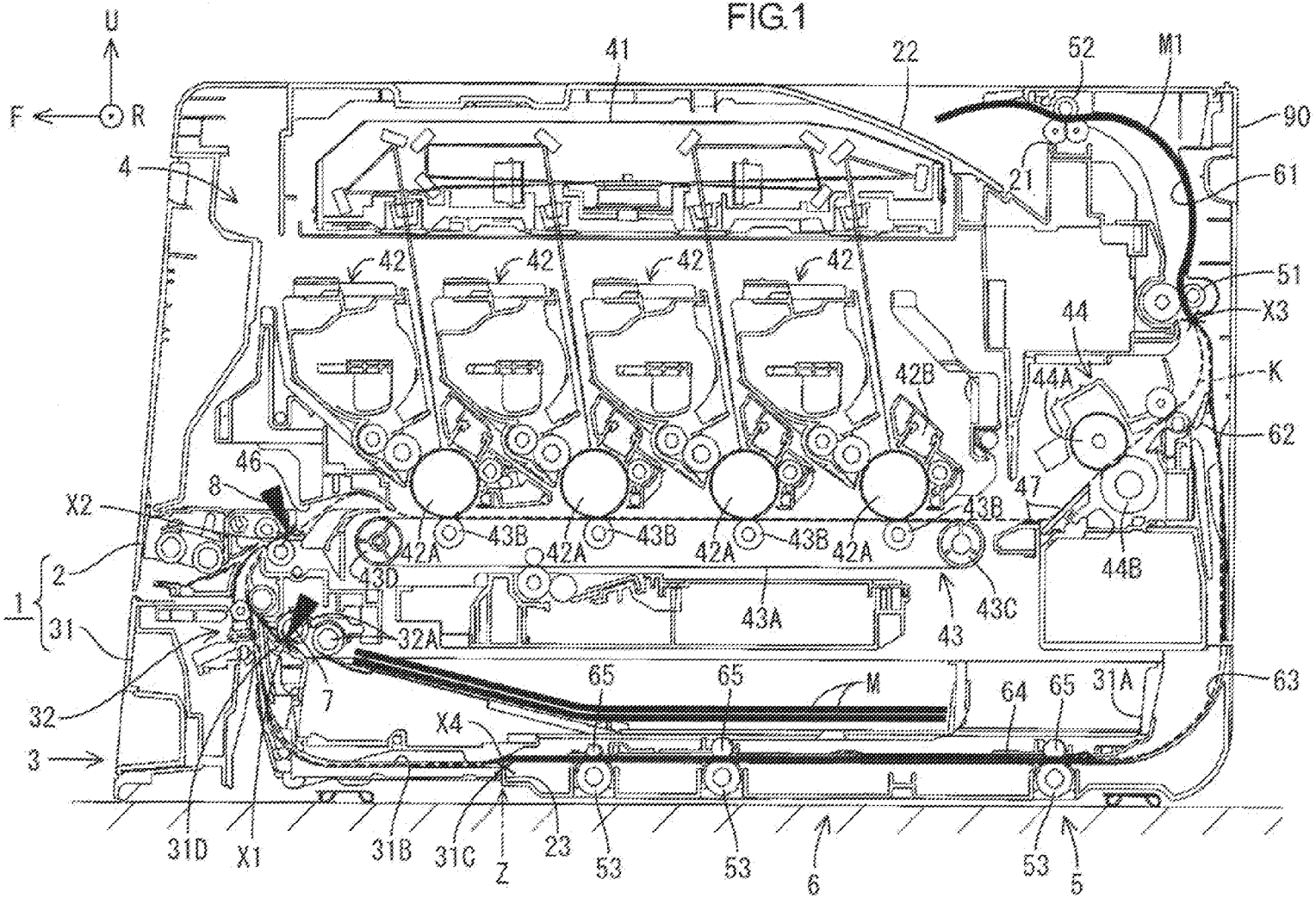
FIG. 1 is a general construction view of a printer according to one illustrative aspect.
Figure 2:
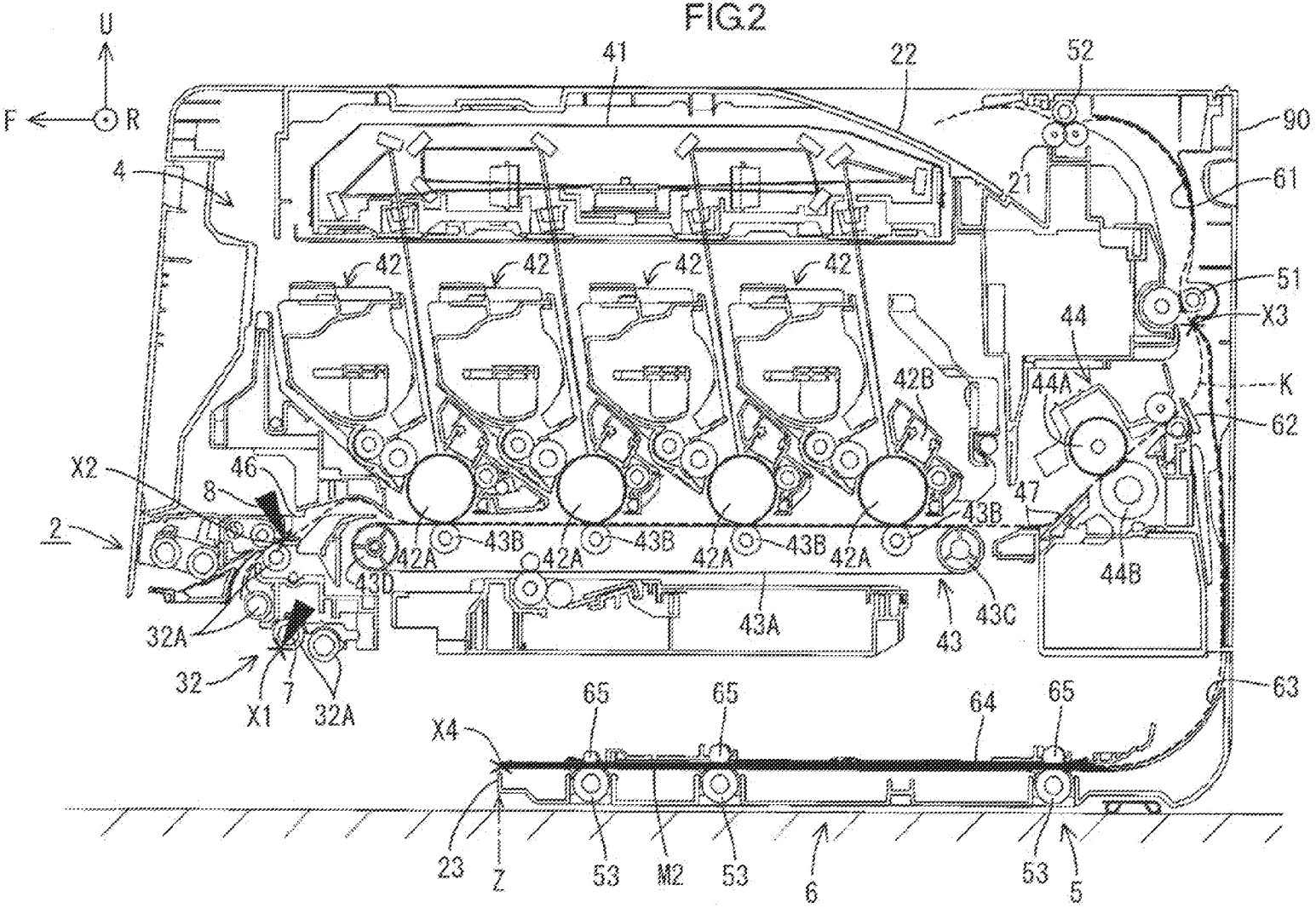
FIG. 2 is a general construction view of a printer from which a sheet tray 31 is removed.

A printer 1 according to one illustrative aspect will be hereinafter explained with reference to FIGS. 1 to 5. The printer 1 is one of examples of an image forming apparatus and is a tandem-type color printer. In the following explanation, a left side on a paper in FIG. 1 is a front side (F) of the printer 1, a front side on a paper in FIG. 1 is a right side (R), and an upper side on a paper in FIG. 1 is an upper side (U). A dotted line K in FIGS. 1 and 2 represents a conveyance path of a sheet M.

(Configuration of Printer)

As illustrated in FIG. 1, the printer 1 is an apparatus that forms images on both sides of a sheet M and includes a sheet supply unit 3, an image forming unit 4, a roller mechanism 5, a guide mechanism 6, a rear end sensor 7, and a resist sensor 8. The sheet M may not necessarily be a paper sheet but may be a plastic sheet as long as an image is printed thereon.

(1) Sheet Supply Unit

The sheet supply unit 3 is provided in a lower portion of the printer 1 and includes a sheet tray 31 and a supply mechanism 32. As illustrated in FIG. 2, a main body 2 of the printer 1 corresponds to a part of the printer except for the sheet tray 31. The sheet tray 31 is one of examples of a movable unit and includes a container 31A in which a plurality of sheets M are put. The sheet tray 31 is pulled frontward so as to be away from the main body 2 and removed therefrom and pushed rearward into the main body to be mounted thereto. A position in which the sheet tray 31 is mounted in FIG. 1 is referred to as a guide position Z.

As illustrated in FIG. 1, the sheet tray 31 includes a movable guide 31B. The movable guide 31B is one of examples of a movable unit guide and a re-guiding guide. The movable unit guide 31B extends frontward from a movable unit connection end 31C that is a rear end thereof and is curved upwardly on a middle portion thereof. When the sheet tray 31 is in the guide position Z, the movable unit guide 31B is communicated with a guide (a sheet supply path) that is configured with the supply roller 32A of the supply mechanism 32. Accordingly, the sheet M is guided from the sheet tray 31 to the main body 2. The movable unit guide 31B is communicated with a main body side re-convey guide 63 that is arranged on the main body 2 side, and accordingly, the sheet M is guided from the main body 2 to the sheet tray 31. When the sheet tray 31 is in the guide position Z, the movable unit connection end 31C that is located at a rear end of the movable unit guide 31B faces a main body connection end 23 of the main body side re-convey guide 63 so as to be in contact with each other, as illustrated in FIG. 1, for example. The movable unit connection end 31C and the main body connection end 23 may not be in contact with each other but may have a gap therebetween as long as the sheet M is smoothly conveyed from the main body side re-convey guide 63 to the movable unit guide 31B. When the sheet tray 31 is in the guide position Z, an upper surface of the movable unit guide 31B and an upper surface of a main body side re-convey guide 63 are on a same plane, as illustrated in FIG. 1, for example.

The supply mechanism 32 includes a plurality of supply rollers 32A each of which starts to rotate in response to a supply command from a controller 81 and conveys the sheets M in the sheet tray 31 one by one to the image forming unit 4. Each supply roller 32A is driven to rotate so as to convey the sheet M by a roller driving unit 54 including a driving motor (not illustrated). The driving motor is a stepping motor, for example.

(2) Image Forming Unit

The image forming unit 4 is configured to form an image on the sheet M that is conveyed from the sheet supply unit 3. The image forming unit 4 includes an exposure unit 41, a plurality of process units 42 (four process units in FIG. 1), a transfer unit 43, and a fixing unit 44. The exposure unit 41 is provided in an upper portion within the main body 2. The exposure unit 41 includes a laser light source (not illustrated), a polygon mirror (illustrated without any reference number), a plurality of lenses and a plurality of reflection mirrors. The exposure unit 41 exposes a surface of each photosensitive drum 42A with laser beam exiting from the laser light source according to image data.

The process units 42 are arranged serially in a direction from the front side to the rear side of the printer 1 between the sheet tray 31 and the exposure unit 41. Each process unit 42 includes a photosensitive drum 42A, a charging unit 42B, a developing roller and a toner container (without reference numerals). Each process unit 42 is substantially the same in structure, except that each process unit 42 accommodates a different color of toner in the toner container. The transfer unit 43 is arranged between the sheet tray 31 and the process units 42. The transfer unit 43 includes an endless conveyer belt 43A stretched between a driving roller 43C and a driven roller 43D, and four transfer rollers 43B. The conveyer belt 43A is arranged around the driving roller 43C and the driven roller 43D. An outer surface of the conveyer belt 43A is in contact with each photosensitive drum 42A and an inner surface of the conveyer belt 43A is in contact with each transfer roller 43B such that the corresponding photosensitive drum 42A and transfer roller 43B hold the conveyer belt 43A therebetween.

The fixing unit 44 is disposed on a rear side from the process units 42 and includes a heat roller 44A and a pressure roller 44B that is disposed to face the heat roller 44A and press the heat roller 44A. An exit 21 and a discharge tray 22 are disposed on an upper surface of the main body 2. A roller mechanism 5 discharges the sheet M that passes through the fixing unit 44 to the discharge tray 22 via the exit 21. A process convey system configuring the image forming unit 4 such as the photosensitive drum 42A, the transfer unit 43, and the fixing unit 44 are driven to rotate to convey the sheet M by a process driving unit 45 (see FIG. 4) including a driving motor (not illustrated). The driving motor is a stepping motor, for example.

(3) Roller Mechanism, Guide Mechanism

The roller mechanism 5 and the guide mechanism 6 function as a discharge mechanism for discharging the sheet M conveyed from the image forming unit 4 to the outside of the main body 2. Also, the roller mechanism 5 and the guide mechanism 6 function as a re-convey unit for re-conveying a reversed sheet M to the image forming unit 4. An image is formed on one surface of the sheet M by the image forming unit 4 and the sheet M is reversed and the reversed sheet M is conveyed to the image forming unit 4 again. A re-convey system such as the supply mechanism 32, the discharge rollers 51, 52, and the convey rollers 53 that convey the reversed sheet M are driven to rotate by the roller driving unit 54 (see FIG. 4) including a driving motor (not illustrated). The supply mechanism 32, the photosensitive drums 42A, the transfer unit 43, the fixing unit 44, and the roller mechanism 5 are examples of a convey unit.

Specifically, the driving motor of the roller driving unit 54 is a stepping motor, for example, that rotates in both a forward and reverse direction. While the driving motor of the roller driving unit 54 rotates in one direction (hereinafter, a forward direction), the discharge rollers 51, 52 rotate in a direction in which the sheet M is conveyed to the exit 21 (in a clockwise direction in FIG. 1). While the driving motor of the roller driving unit 54 rotates in another direction (hereinafter, a reverse direction), the discharge rollers 51, 52 rotate in a direction in which the sheet M is conveyed to be farther away from the exit 21 (in a counterclockwise direction in FIG. 1). The convey rollers 53 are connected to the driving motor of the roller driving unit 54 via a pendulum gear (not illustrated). The convey rollers 53 always rotate in the direction in which the sheet M is conveyed frontward (in a counterclockwise direction in FIG. 1), while the driving motor of the roller driving unit 54 rotate in both the forward direction and the reverse direction.

The guide mechanism 6 includes a discharge guide 61, a flapper 62, and a main body side re-convey guide 63 and extends from the vicinity of the exit 21 to the guide position Z via a rear portion and a bottom portion of the main body 2. Specifically, the flapper 62 is disposed on the rear side of the fixing unit 44 and configured to move swingably in a front-and-rear direction. The discharge guide 61 extends upwardly from the vicinity of the flapper 62 and extends to be curved toward the exit 21. The discharge rollers 51, 52 are rotatably disposed in recess portions formed on the discharge guide 61.

The main body side re-convey guide 63 extends downwardly from the vicinity of the flapper 62 so as to be curved frontward in the bottom portion of the main body 2 and further extends to the main body connection end 23. When the sheet tray 31 is in the guide position Z as illustrated in FIG. 1, the main body connection end 23 is communicated with the movable unit connection end 31C that is a rear end of the movable guide 31B.

Each convey roller 53 is rotatably disposed in a recess portion formed on the main body side re-convey guide 63. The supply mechanism 32, the outer surface of the convey belt 43A, and the fixing unit 44 also function as a guide guiding the sheet M. Therefore, image forming unit guides 46, 47, the supply mechanism 32, the convey belt 43A, and the fixing unit 44 included in the image forming unit 4 are examples of the main body guide.

Figure 3:
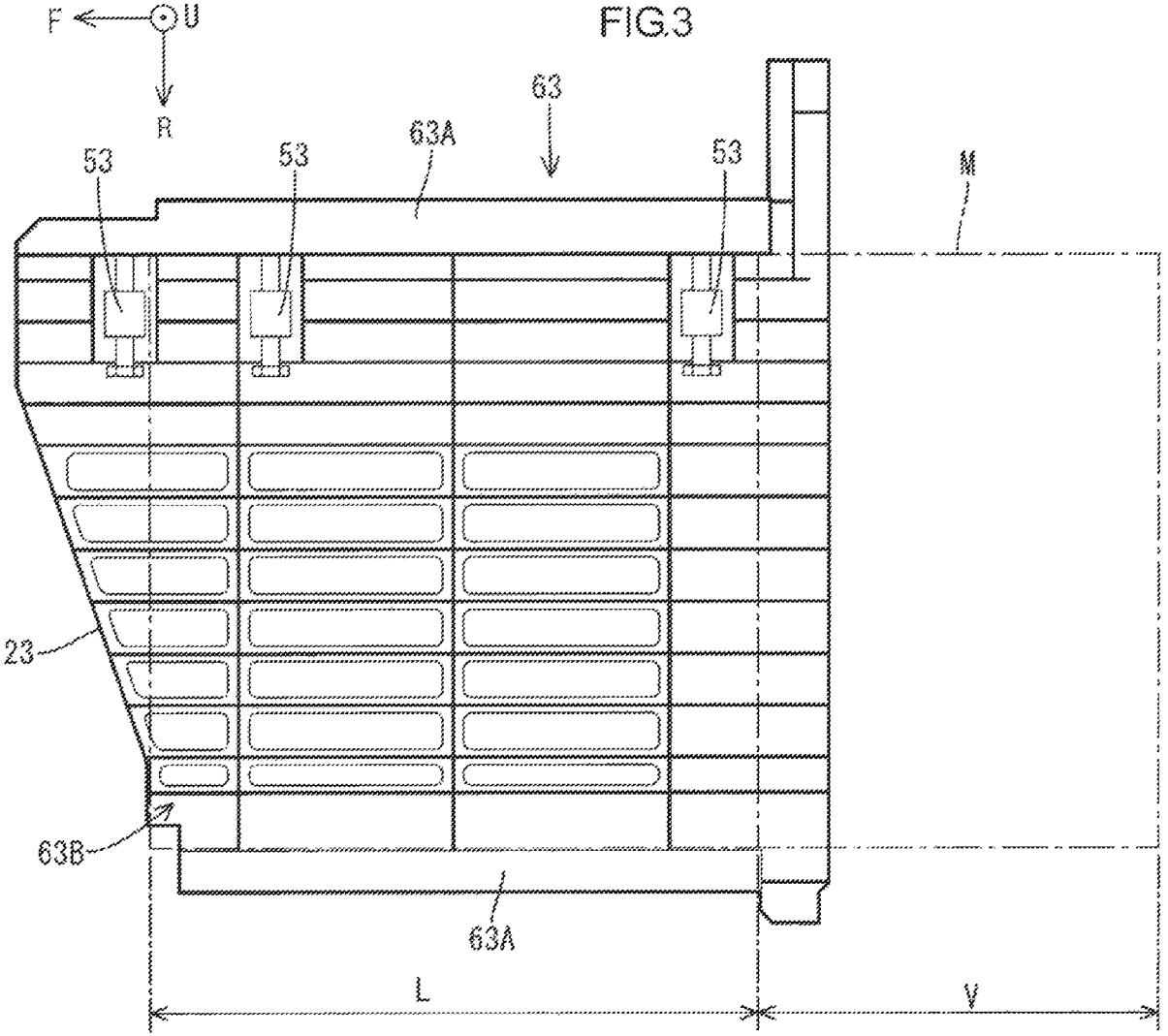
FIG. 3 is an upper view illustrating a part of a re-convey guide on which a convey roller 53 is mounted.

FIG. 3 illustrates a portion of the main body side re-convey guide 63 in which the convey rollers 53 are disposed and that is seen from the above. In FIG. 3, the front end portion of the main body side re-convey guide 63 is the main body connection end 23. In FIG. 3, the sheet M that is conveyed with being curved by the main body side re-convey guide 63 is illustrated by a dashed-dotted line, and the sheet M is illustrated with being exploded in a planar state. As illustrated in FIGS. 1 and 2, a portion of the main body side re-convey guide 63 in which the convey roller 53 is arranged is covered with an upper guide 64 and a pinch roller 65 is rotatably mounted on the upper guide 64 so as to face each convey roller 53.

A guide side wall 63A is formed on a right side and a left side of the main body side re-convey guide 63 to guide right and left sides of the sheet M. Each guide side wall 63A is one of examples of a side guide portion and extends rearward from the main body connection end 23. The guide side walls 63A are continuously formed from the main body side re-convey guide 63 and made of a same material such as resin and extends from the man body connection end 23. Hereinafter, an area in the main body side re-convey guide 63 that is between the guide side walls 63A is referred to as a continuous guide area 63B (see FIG. 3). The continuous guide area 63B has a guide length L in a sheet conveyance direction.

(4) Rear End Sensor, Resist Sensor

A rear end sensor 7 is arranged in the vicinity of the supply mechanism 32. The rear end sensor 7 is configured to detect whether a sheet M conveyed from the sheet tray 31 is in a detection position X1 that is a lower portion of the supply mechanism 32. The rear end sensor 7 outputs a detection signal SG1 of a low level, if the sheet tray 31 is in the guide position Z and the sheet M is in the detection position X1. The rear end sensor 7 outputs a detection signal SG1 of a high level, if the sheet tray 31 is in the guide position Z and the sheet M is not in the detection position X1 and if the sheet tray 31 is not in the guide position Z. The rear end sensor 7 is one of examples of a position detector and the detection signal SG1 is one of examples of a position detection signal.

Specifically, the rear end sensor 7 includes an actuator (not illustrated) that is swingably mounted in the main body 2. If the sheet tray 31 is in the guide position Z and the sheet M is not in the detection position X1, the actuator is pressed by the guide 31D of the sheet tray 31 and to be in a predetermined posture. Accordingly, the rear end sensor 7 outputs a detection signal SG1 of a low level. In such a state, if the sheet M is conveyed and reaches the detection position X1, the actuator is pressed by the sheet M and changes its posture from the predetermined posture, and the rear end sensor 7 outputs the detection signal SG1 of a high level.

As illustrated in FIG. 2, if the sheet tray 31 is not in the guide position Z, the actuator changes its posture from the predetermined posture due to its own weight and the rear end sensor 7 outputs the detection signal SG1 of a high level. A controller 81 determines that a rear end of the sheet M that is conveyed by the supply mechanism 32 is detected based on the detection signal SG1, and the controller 81 determines a timing at which the supply mechanism 32 starts supply of a next sheet M based on the detection timing at which the rear end of the sheet M is detected.

The resist sensor 8 also detects whether a sheet is in a detection position X2 (the detection area) that is on a upstream side in the sheet conveyance direction with respect to the transfer unit 43. The resist sensor 8 outputs a detection signal SG2 according to presence or non-presence of the sheet M in the detection position X2. The resist sensor 8 transfers the detection signal SG2 to the controller 81. The controller 81 determines that the sheet M is detected according to the detection signal SG2 and determines a timing at which an image is formed by the image forming unit 4 based on the detection timing at which the sheet M is detected. The resist sensor 8 is one of examples of the sheet detector and the detection signal SG2 is one of examples of the sheet detection signal.

(Electric Configuration of Printer)

Figure 4:
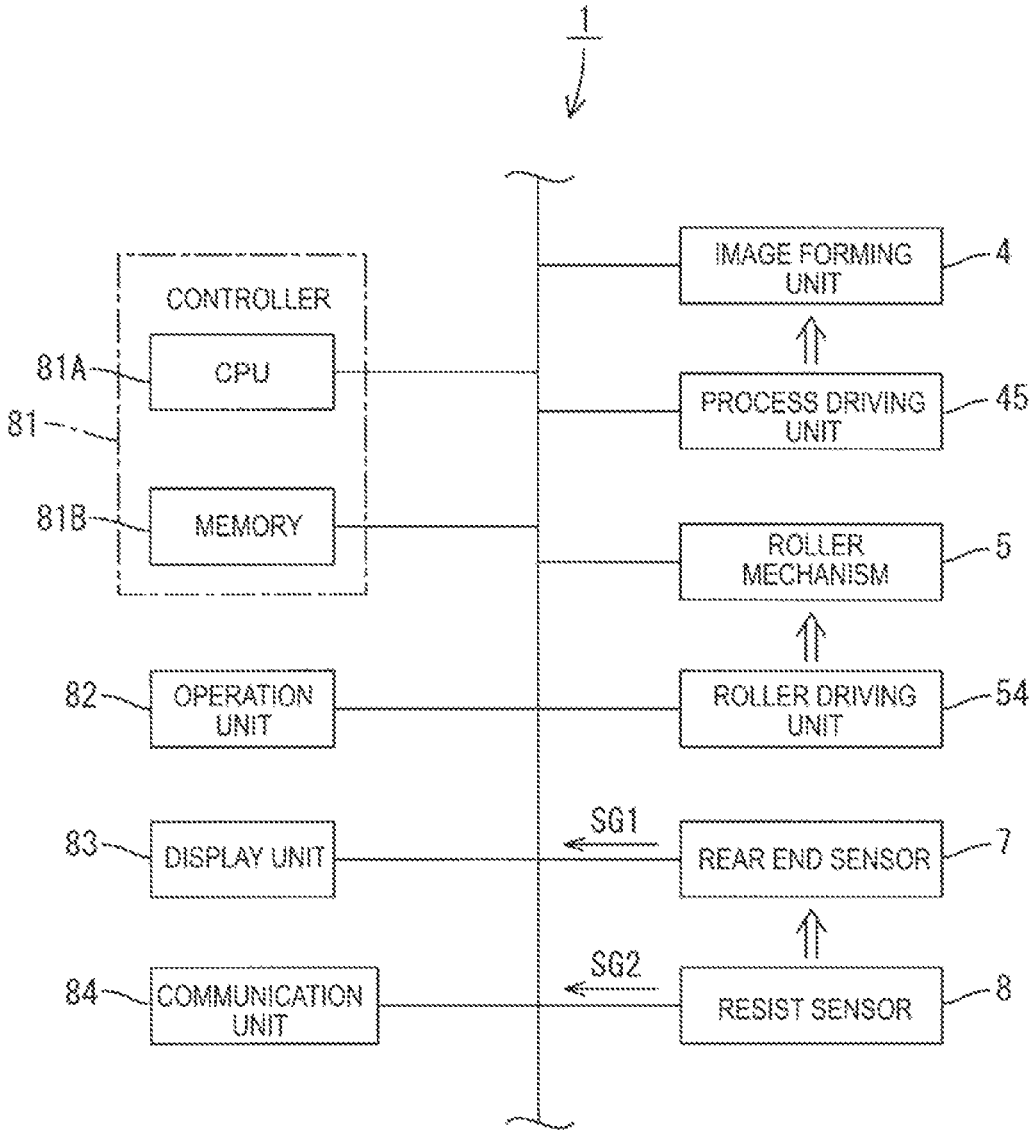
FIG. 4 is a block diagram illustrating an electric configuration of the convey roller 53.

As illustrated in FIG. 4, the printer 1 includes the controller 81, the image forming unit 4, the process driving unit 45, the roller mechanism 5, the roller driving unit 54, the rear sensor 7, the resist sensor 8, an operation unit 82, a display unit 83, and a communication unit 84.

The controller 81 includes a central processing unit (CPU) 81A and a memory 81B. The memory 81B stores a program for executing a re-convey process and a program for executing various operations of the printer 1. The CPU 81A controls each unit of the printer 1 according to the program read from the memory 81A. The various programs may be stored in a ROM, a RAM or in a non-volatile memory such as a CD-ROM, a hard disc device, and a flash memory®.

The operation unit 82 includes a plurality of buttons and a user executes various input operations via the operation unit 82. The display unit 83 includes a liquid crystal display and a lamp and can display various setting screens or operation states of the apparatus. The communication unit 84 enables the printer 1 to execute data transmission with an external device via a communication line. The controller 81 receives print data from the external device via the communication unit 84.

(Re-convey Process)

Figure 5:
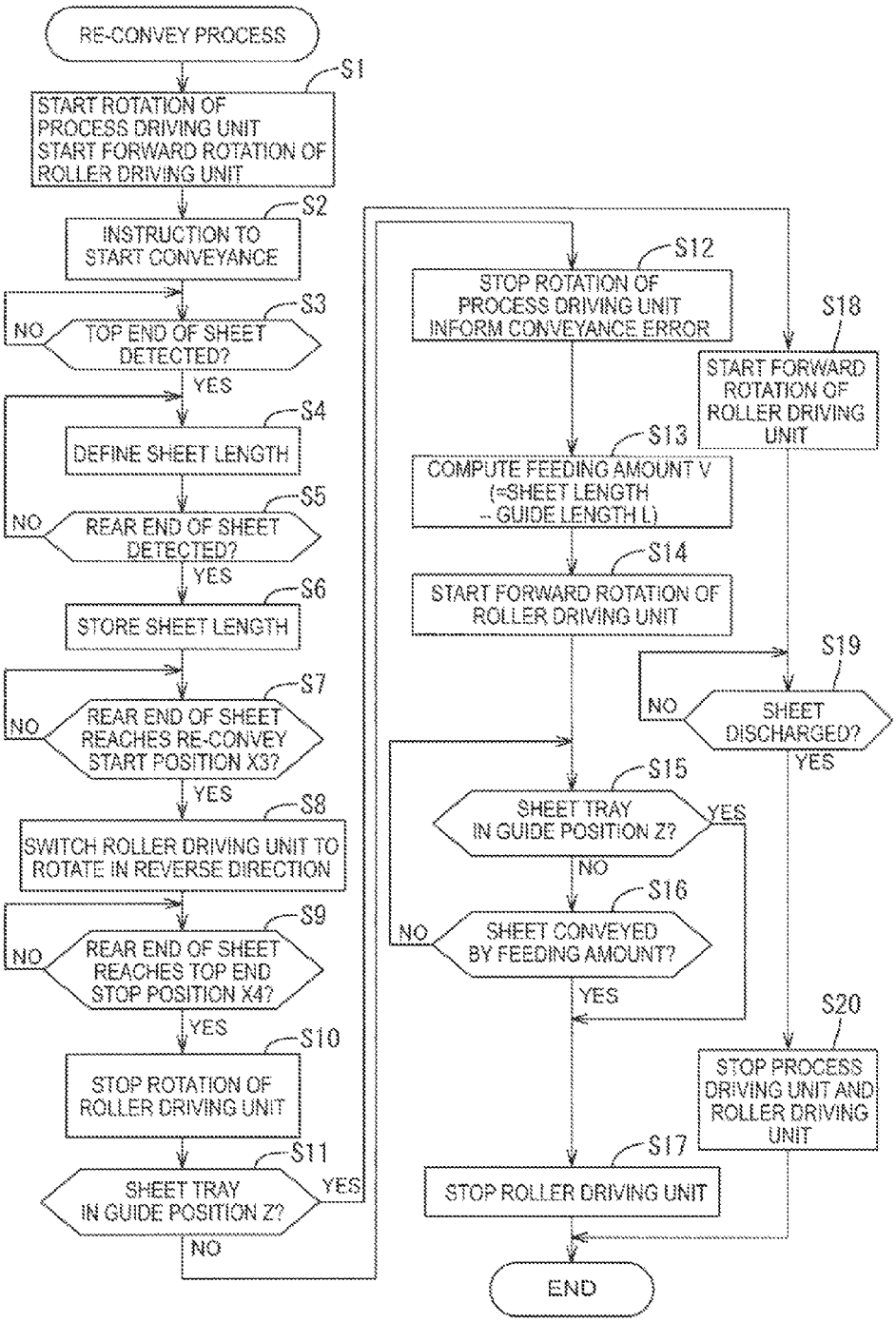
FIG. 5 is a flowchart illustrating a re-convey process.

The controller 81 executes a re-convey process illustrated in FIG. 5 in executing two-sided printing. For example, if the print data received via the communication unit 84 includes information instructing execution of the two-sided printing, the controller 81 executes the re-convey process.

The controller 81 transmits a rotation start command to the process driving unit 45 to drive the process convey system such as the photosensitive drums 42A and rotate them (S1). The controller 81 transmits a forward rotation start command to the roller driving unit 54 to drive the re-convey system such as the supply mechanism 32 and rotate it (S1). Next, the controller 81 transmits a supply command to the supply mechanism 32 (S2). Accordingly, the supply mechanism 32 picks up one of the sheets M in the sheet tray 31 and starts conveyance of the sheet M to the image forming unit 4.

Then, the controller 81 executes a sheet length defining process based on the detection signal SG2 from the resist sensor 8 (S3-S6). In the sheet length defining process, the controller 81 defines a sheet length of the sheet M that is started to be conveyed. The sheet length is a length of the sheet M in the conveyance direction. Specifically, if the detection signal SG2 represents that no sheet is in the detection position X2, the controller 81 determines that the resist sensor 8 does not detect a top end of the sheet M in the conveyance direction and waits (S3: NO). If the resist sensor 8 outputs the detection signal SG2 representing that a sheet is in the detection position X2 after outputting the detection signal SG2 representing that a sheet is not in the detection position X2, the controller 81 determines that the resist sensor 8 detects a top end of the sheet M (S3: YES). Accordingly, the controller 81 defines a length of the sheet M (S4).

The number of steps that are applied to the process driving unit 45 to drive and rotate the drive rollers is proportional to a length of a portion of the sheet M that has passed the detection position X2. Therefore, the controller 81 counts the number of steps to define the length of the sheet. Then, if the detection signal SG2 represents that a sheet is in the detection position X2, the controller 81 determines that the resist sensor 8 does not detect a rear end of the sheet M (S5: NO) and continues an operation of defining the sheet length.

Then, if the resist sensor 8 outputs the detection signal SG2 representing that a sheet is not in the detection position X2 after outputting the detection signal SG2 representing that a sheet is in the detection position X2, the controller 81 determines that the resist sensor 8 detects a rear end of the sheet M (S5: YES) and terminates defining the sheet length of the sheet M. The controller 81 defines the counted value of the number of steps that is counted from the detection of the top end of the sheet M to the detection of the rear end of the sheet M as the sheet length of the sheet M and stores the counted value in the memory 81B (S6). The controller 81 controls the image forming unit 4 to form an image on one surface of the sheet M, while the sheet M is conveyed by the process convey system.

Next, the controller 81 determines whether a rear end of the sheet M that is conveyed by the process convey system or the discharge rollers 51, 52 reaches the re-convey start position X3 (S7). The re-convey start position X3 is a branch position at which the sheet convey path branches into two by the flapper 62. For example, if the controller 81 determines that the number of steps applied to the driving roller of the process driving unit 45 or the counted time since the detection of the rear end of the sheet M reaches a first reference value, the controller 81 determines that the rear end of the sheet M reaches the re-convey start position X3. The first reference value corresponds to the number of steps or the time counted while the rear end of the sheet M is conveyed from the detection position X2 to the re-convey start position X3. As long as the controller 81 determines that the rear end of the sheet M does not reach the re-convey start position X3, the controller 81 waits (S7: NO).

As illustrated in FIG. 1, if the rear end of the sheet M1 in the conveyance direction toward the exit 21 reaches the re-convey start position X3, the controller 81 determines that the rear end of the sheet M reaches the re-convey start position X3 (S7: YES). According to such determination, the controller 81 temporarily stops the roller driving unit 43 and provides the roller driving unit 43 with a reverse rotation command to control the rollers to rotate in the reverse direction. Further, the controller 81 controls the flapper 62 to change its posture from a rearward tilted posture in FIG. 1 to a frontward tilted posture in FIG. 2 (S8). Accordingly, the sheet M1 is conveyed toward the main body side re-convey guide 63 by the reverse rotation of the discharge rollers 51, 52. The sheet M1 is conveyed toward the main body side re-convey guide 63 with its rear end (a lower end in FIG. 1) in the conveyance direction toward the exit 21 being as a head. Hereinafter, the sheet M that is conveyed toward the main body side re-convey guide 63 is referred to as a re-convey sheet M and a top end of the sheet in the re-conveyance direction is referred to as a rear end of the re-convey sheet M.

The controller 81 determines whether the rear end of the re-convey sheet M reaches the stop position X4 (S9). For example, the main body connection end 23 of the main body side re-convey guide 63 is the stop position X4 (see FIG. 3). For example, the controller 81 determines that the number of steps applied to the driving rollers of the roller driving unit 54 or the counted time counted since the application of the re-convey command reaches a second reference value, the controller 81 determines that the rear end of the re-convey sheet M reaches the stop position X4. The second reference value corresponds to the number steps or the counted time while the rear end of the re-convey sheet M moves from the re-convey start position X3 to the stop position X4. While the controller 81 determines that the rear end of the re-convey sheet M does not reach the stop position X4, the controller 81 waits (S9: NO).

As illustrated in FIG. 2, if the rear end of the re-convey sheet M2 reaches the stop position X4, the controller 81 determines that the rear end of the re-convey sheet M2 reaches the stop position X4 (S9: YES), and executes a stopping process to stop the roller driving unit 54 (S10). At this time, the top end of the re-convey sheet M2 that is an end opposite to the rear end has left and passed through the discharge roller 51.

If the re-convey sheet M2 reaches the main body connection end 23, the controller 81 executes a position determination process for determining whether the sheet tray 31 is in the guide position Z based on the detection signal SG1 from the rear end sensor 7 (S11). Therefore, compared to a configuration in which the position determination process is executed before the re-convey sheet M2 reaches the main body connection end 23, it is determined effectively whether a convey control process is required to be executed according to the latest condition of the sheet tray 31. If the controller 81 receives a detection signal SG1 of a high level within a predetermined time since the conveyance start at S2, the controller 81 determines that the sheet M reaches the detection position X1. If the controller 81 receives the detection signal SG1 of a high level after the predetermined time has passed since the conveyance start at S2, the controller 81 determines that the sheet tray 31 is not in the guide position Z.

If the controller 81 determines that the sheet tray 31 is in the guide position Z (S11: YES), the controller 81 executes a normal sheet conveyance process. Specifically, the controller 81 controls the roller driving unit 54 to start the forward rotation (S18). The controller 81 further controls the image forming unit 4 to form an image on another surface of the re-convey sheet M while the re-convey sheet M is conveyed by the process convey system again. The controller 81 waits until the re-convey sheet M is discharged to the discharge tray 22 (S19: NO), and if the re-convey sheet M is discharged to the discharge tray 22 (S19: YES), the controller 81 stops the process driving unit 45 and the roller driving unit 54 (S20) and terminates the re-convey process.

If the sheet tray 31 is detached from the main body 2 as illustrated in FIG. 2, the re-convey path of the re-convey sheet is cut on its own way and this may cause a conveyance error of the re-convey sheet M. If the controller 81 determines that the sheet tray 31 is not in the guide position Z (S11: NO), the controller 81 executes the conveyance control process (S12 to S17). Specifically, the controller 81 stops the rotation of the process driving unit 45 and controls the display unit 83 to display information relating the conveyance error to inform a user of the conveyance error (S12). Accordingly, the user can know that it is necessary to execute a maintenance operation of removing the re-convey sheet M2 that is in the main body side re-convey guide 63.

However, it is troublesome to remove the re-convey sheet M from the main body side re-convey guide 63 because a gap between the upper guide 64 (one of examples of a opposing member) and the main body side re-convey guide 63 is quite small as illustrated in FIGS. 1 and 2. As will be described, the controller 81 executes a feeding operation and feeds the re-convey sheet M2 on the main body side re-convey guide 63 toward the guide position Z by a feeding amount V and stops the re-convey sheet M2. Therefore, a user can execute a maintenance operation easily compared to a configuration without executing such a feeding operation. The main body side re-convey guide 63 is one of examples of a feeding area.

The controller 81 computes a feeding amount V (S13). The feeding amount V is obtained by subtracting the guide length L of the continuous guide area 63B from the sheet length defined at S6. Therefore, as the sheet length of the sheet M increases, the feeding amount V increases. Accordingly, the sheet M having a great sheet length that makes execution of the maintenance operation to be difficult is fed by a greater feeding amount, and this improves the maintenance operation.

The controller 81 controls the roller driving unit 54 to start rotating in the forward direction (S14) after the computation of the feeding amount V. Then, the controller 81 starts the feeding operation to feed the re-convey sheet M2 that is in the stop position X4 by the feeding amount V. If the controller 81 repeatedly determines that the sheet tray 31 is not in the guide position Z until it completes the feeding operation of the feeding amount V (S15: NO and S16: YES), the controller 81 stops the rotation of the roller driving unit 64 (S17) and terminates the re-convey process. Namely, a feeding execution process (S15: NO, S16, S17) is performed.

Thus, the controller 81 executes the conveyance control process while the conveyance of the re-convey sheet M is stopped. Accordingly, if the controller 81 determines that the sheet tray 31 is not in the guide position Z, the re-convey sheet M can be stably conveyed with feeding outside from a temporal stop state. Further, after completion of the feeding operation, the top end of the re-convey sheet M2 that is a rear side in the feeding direction is still in the continuous guide area 63B. Therefore, when the re-convey sheet M2 is removed from the main body side re-convey guide 63, it is less likely to happen that the left and right sides of the re-convey sheet M2 are hung up on the rear end portion of the guide side wall 63A and tore and the tore sheet pieces may remain in the main body 2.

If the controller 81 determines that the sheet tray 31 is in the guide position Z during the feeding operation by the feeding amount V (S15: YES and S16: NO), the controller 81 does not complete the feeding operation and stops the rotation of the roller driving unit 54 to execute a recovery process (S17) and terminates the re-convey process. Namely, a feeding inexecution process (S15: YES, S17) is performed. Accordingly, it is less likely to happen that the feeding operation is continuously executed even after the sheet tray 31 is set in the guide position Z and a sheet jam is caused.

(Effects of Illustrative Aspect)

If the sheet tray 31 is not in the guide position Z, the sheet M may not be guided correctly and therefore, the conveyance of the sheet M may be stopped. However, if the sheet M is in the vicinity of the guide position Z, a user may remove the sheet M easily by feeding the sheet M toward the guide position Z. In the printer 1 according to one illustrative aspect, if it is determined that the sheet tray 31 is not in the guide position Z, the sheet M that is on the main body side re-convey guide 63 is fed toward the guide position Z. Accordingly, if the sheet tray 31 is moved from the guide position Z with respect to the main body 2, the sheet M is easier to be removed from the main body side re-convey guide 63 compared to a configuration without executing the feeding operation of the sheet M. This reduces user's load of the maintenance operation.

<Other Illustrative Aspects>

The technology disclosed in the specification is not limited to the illustrative aspects described above with reference to the drawings. The following illustrative aspects may be included in the technical scope of the disclosed technology.

An image forming apparatus is not limited to a tandem type apparatus, but may be an image forming apparatus of a color printing method such as four-cycle type. Further, an image forming apparatus is not necessarily a color printer but may be a black-and-white printer, and also may be a printer that can execute only one-side printing. An image forming apparatus is not limited to a polygon scanning type apparatus but may be an apparatus using other exposure method such as a LED (laser) type. Further, an image forming apparatus is not limited to an electrophotographic type apparatus but may be an ink jet type apparatus. Further, an image forming apparatus may be a copying apparatus having a printing function and a scanner function or a multi function apparatus that can execute various functions including printing.

A movable unit may not have a function of storing sheets M therein. A movable unit is not necessarily configured to be removed by being pulled out from the main body but may be configured not to be removed and fixed by a stopping mechanism. A movable unit is not necessarily configured to be pulled out from the main body but may be configured to be supported to the main body swingably by a shaft like a open/close cover. A movable unit may be configured to include a conveyer conveying a sheet such as a convey roller. Further, a movable unit may not be necessarily configured to be moved manually by a user but may be automatically moved by control of the controller 81. A movable unit is configured to include a guide guiding a sheet and configured to be movable with respect to the main body.

A movable unit may be the process unit 42 and the transfer unit 43, and in such a configuration, the photosensitive drum 42A and the convey belt 43A are examples of the movable unit guide. In the printer 1, an upper cover of the main body 2 is opened such that the process units 42 and the transfer unit 43 are movable from the position illustrated in FIGS. 1 and 2 (one example of the guide position). If the controller 81 determines that the process units 42 and the transfer unit 43 are moved from the guide position, the sheet M may be fed toward an arrangement space of the process units 42 by the supply mechanism 32. If the fixing unit 44 is configured to be able to be driven and rotate in both forward and reverse directions, the following configuration is effective. If the controller 81 determines that the process units 42 and the transfer unit 43 are moved from the guide position, the controller 81 controls the fixing unit 44 to rotate in a reverse direction to feed the sheet M toward the arrangement space of the process units 42.

A movable unit may be the discharge tray 22. In such a configuration, an upper surface of the discharge tray 22 is an example of the movable unit guide. The discharge tray 22 is able to be rotatably open and closed around its front end side. In a closed state illustrated in FIGS. 1 and 2, the discharge tray 22 is in the guide position so as to guide the sheet M discharged from the exit 21, and in an open state, the discharge tray 22 is not in the guide position. If the controller 81 determines that the discharge tray 22 is moved from the guide position, the controller 81 controls the discharge rollers 51, 52 to rotate in the forward direction and feed the sheet M toward the discharge tray 22.

The main body side re-convey guide 63 is not necessarily configured such that the guide side walls 63A are disposed on the left and right sides but may be disposed on only one side.

A position detector is not limited to the rear end sensor 7 but may be a sensor that outputs a detection signal having one level when the sheet tray 31 is in the guide position and the sheet M is not in the detection position X1 and outputs a detection signal having another level that is different from the one level when the sheet tray 31 is not in the guide position. A position detector may be a sensor that does not have a function of detecting presence and non-presence of a sheet M and that is exclusive for detecting whether the sheet tray 31 is in the guide position Z. A position detector may be any type of sensors including an optical sensor, a magnetic sensor, a contact-type sensor.

A sheet detector is not limited to the resist sensor 8 but may be a sensor that detects presence and non-presence of the sheet M in a different position such as a rear end sensor. A sheet detector is not necessarily a sensor detecting presence and non-presence of the sheet M that is provided on the main body side but may be a sensor detecting presence and non-presence of the sheet M that is provided on the movable unit side.

In the illustrative aspect, the controller 81 is configured to execute the re-convey process by the CPU 81A and the memory 81B. However, the controller 81 may be configured to execute the re-convey process by a plurality of CPUs or only by a hardware circuit such as an ASIC (Application Specific Integrated Circuit).

A sheet length defining process is not limited to a process for defining a sheet length based on a detection result of the sensor detecting presence or non-presence of a sheet. The controller 81 may be configured to execute following process steps instead of S3 to S6. For example, if the printer 1 includes a sensor detecting a sheet length of a sheet M within the sheet tray 31, the controller 81 may define a sheet length based on a detection result of the sensor. Information regarding a sheet length of a sheet M in the sheet tray 31 may be previously stored in the memory 81B according to user's input operation or setting information of the sheet tray 31. In such a case, the controller 81 may define a sheet length based on the information. In the configuration of the illustrative aspect, the sheet length is actually measured such that the sheet M may be fed by an effective amount in the convey control process.

The controller 81 may counts time from detection of the top end of the sheet M in the process of S4 and measure a sheet length based on the counted time.

The controller 81 may execute the position determination process before stopping rotation of the roller driving unit 54 or during the conveyance of the sheet M.

The controller 81 may calculate the feeding amount V in defining the sheet length (S6). In the illustrative aspect, the feeding amount V is calculated only when it is determined that the sheet tray 31 is not in the guide position Z and the feeding amount V is required. Therefore, calculation of the feeding amount V is executed effectively.

As is in the illustrative aspect, the controller 81 is configured to feed the sheet M to project a part of the sheet M to the outside of the main body 2. However, the sheet M that is located on a rear side of the main body connection end 23 may be fed to the vicinity of the main body connection end 23 and not to project from the main body 2. With such a configuration, the user's load of the maintenance operation is reduced compared to a configuration without executing the feeding operation.

In the illustrative aspect, the controller 81 is configured to feed the sheet M toward the guide position Z. However, the controller 81 may feed the sheet M in a direction so as to be away from the guide position Z. For example, the printer may include a rear cover 90 that configures a part of the main body side re-convey guide 63 so as to be open and closed. If the rear cover 90 is opened, the re-convey sheet M that is in the main body side re-convey guide 63 can be removed from the rear side of the printer 1. If the controller 81 determines that the sheet is in the main body side re-convey guide 63 and the sheet tray 31 is not in the guide position Z, the re-convey sheet M2 may be fed to a direction so as to be away from the guide position Z. Accordingly, the re-convey sheet M2 is easily removed from the rear side of the printer 1 and this improves the maintenance operation.

The sheet M in the main body side re-convey guide 63 may not be always fed. For example, the controller 81 determines whether the sheet tray 31 is in the guide position Z while the sheet M is located in the convey path extending from the supply mechanism 32 to the image forming unit 4. The supply mechanism 32 and the process convey system are configured to rotate in forward and reverse direction. If the controller 81 determines that the sheet tray 31 is not in the guide position Z, the controller 81 may rotate the supply mechanism 32 in the reverse direction to feed the sheet M from the supply mechanism 32 toward the guide position Z. According to the configuration, an area ranging from the supply mechanism 32 to the image forming unit 4 is an example of the feeding area.

A feeding amount may be determined with no relation to a sheet length but a fixed value. With the above configuration, the feeding amount is adjusted according to the sheet length of the sheet M. Therefore, the feeding operation is less likely to continue after the sheet M having a relatively small sheet length already passes the convey roller 53 and accordingly, power is less likely to be wasted.

The controller 81 may execute the convey control process during the conveyance of the sheet M. For example, the controller 81 may start the forward rotation of the roller driving unit 54 between the stop of rotation of the roller driving unit (S10) and the position determination process (S11).

The invention claimed is:

1. An image forming apparatus comprising:

a conveyer configured to convey a sheet;

an image forming unit configured to form an image on the sheet;

a main body including a main body guide, the main body guide being positioned downstream of the image forming unit in a feeding direction of the sheet and being configured to guide the sheet toward the image forming unit;

a movable unit including a movable unit guide connected to the main body guide, the movable unit guide being configured to guide the sheet conveyed from the main body guide toward the image forming unit, the movable unit being movable with respect to a guide position at which the sheet is guided;

a position detector configured to output a position detection signal according to a state of the movable unit representing whether the movable unit is in the guide position or not; and a controller configured to:

determine whether the movable unit is in the guide position based on the position detection signal;

perform a waiting process in which the conveyer is controlled to temporarily stop conveying the sheet at a feeding area on the main body guide; and perform a feeding execution process in which the conveyer is controlled to feed the sheet by a feeding amount in a case where it is determined that the movable unit is not in the guide position while the controller is performing the waiting process.

2. The image forming apparatus according to claim 1, wherein the controller is further configured to feed the sheet by a greater feeding amount as the sheet has a longer sheet length in its conveyance direction.

3. The image forming apparatus according to claim 2, further comprising a sheet detector configured to output a sheet detection signal representing whether a sheet that is being conveyed is in a detection area, wherein the controller is further configured to define a sheet length of the sheet that is being conveyed in its conveyance direction based on the sheet detection signal.

4. The image forming apparatus according to claim 1, wherein the main body guide has a side guide portion configured to guide a side of the sheet and disposed on an end of the main body guide adjacent to the guide position, and the controller is further configured to control the conveyer to feed the sheet until a rear end of the sheet in a sheet conveyance direction reaches the side guide portion.

5. The image forming apparatus according to claim 1, wherein the movable unit is detachably mounted to the main body, and one end of the main body guide and one end of the movable unit guide face each other when the movable unit is in a mounted position with respect to the main body.

6. The image forming apparatus according to claim 5, wherein the movable unit further includes a sheet container configured to support a plurality of sheets.

7. The image forming apparatus according to claim 1, wherein the controller is further configured to:

obtain a length of the main body guide and a length of the sheet that is conveyed in a conveyance direction in which the sheet is conveyed, and compute the feeding amount by subtracting the length of the main body guide from the length of the sheet.

8. The image forming apparatus according to claim 1, wherein the main body further includes an opposing member arranged along the main body guide and to face the main body guide so as to form a space therebetween, wherein the main body guide and the opposing member guide the sheet in the space therebetween.

9. The image forming apparatus according to claim 1, wherein a stop position where the sheet is stopped by the waiting process corresponds to an end portion of the main body guide.

10. The image forming apparatus according to claim 9, wherein, in the feeding execution process, the conveyer is controlled to feed the sheet at the feeding amount such that at least a leading edge of the sheet is beyond the end portion of the main body guide, the end portion of the main body guide being connected to the movable unit guide when the movable unit is in the guide position.

11. The image forming apparatus according to claim 1, wherein, in the feeding execution process, the conveyer is controlled to feed the sheet at the feeding amount such that at least a leading edge of the sheet is beyond an end portion of the main body guide, the end portion of the main body guide being connected to the movable unit guide when the movable unit is in the guide position.

* * * * *